US008624139B2

(12) United States Patent
Huang

(10) Patent No.: US 8,624,139 B2
(45) Date of Patent: Jan. 7, 2014

(54) KEY BUTTON MECHANISM AND ELECTRONIC DEVICE USING SAME

(75) Inventor: Guo-Zhao Huang, Shenzhen (CN)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 206 days.

(21) Appl. No.: 13/274,582

(22) Filed: Oct. 17, 2011

(65) Prior Publication Data

US 2012/0241295 A1 Sep. 27, 2012

(30) Foreign Application Priority Data

Mar. 25, 2011 (CN) ..... 2011 1 0073545

(51) Int. Cl.
*H01H 15/02* (2006.01)

(52) U.S. Cl.
USPC ..... 200/296; 200/547; 200/548

(58) Field of Classification Search
USPC ..... 200/547, 548, 332.1, 550, 536, 562, 200/563, 541; 361/752
See application file for complete search history.

(56) References Cited

U.S. PATENT DOCUMENTS

| | | | | |
|---|---|---|---|---|
| 3,674,953 | A * | 7/1972 | Brevick | 200/548 |
| 4,441,000 | A * | 4/1984 | Suwa | 200/548 |
| 8,003,908 | B2 * | 8/2011 | Zuo | 200/332.1 |
| 8,080,757 | B2 * | 12/2011 | Zuo | 200/548 |
| 2008/0060929 | A1 * | 3/2008 | Iijima | 200/547 |

* cited by examiner

*Primary Examiner* — Renee S Luebke
*Assistant Examiner* — Harshad Patel
(74) *Attorney, Agent, or Firm* — Altis Law Group, Inc.

(57) ABSTRACT

A key button mechanism includes a retaining board, a sliding board, a key button and a stopping member. The sliding board is slidably mounted to the retaining board. The sliding board is capable of sliding between a first configuration and a second configuration. The key button is fixed to the sliding board so the key button can be slid relative to the retaining board. The stopping member is located between the retaining board and the sliding board. The stopping member, which can be overcome with fingernail pressure, holds the sliding board in either the first configuration or the second configuration.

8 Claims, 7 Drawing Sheets

KEY BUTTON MECHANISM AND ELECTRONIC DEVICE USING SAME

BACKGROUND

1. Technical Field

This disclosure relates to key button mechanisms, particularly to key button mechanisms used in a portable electronic device.

2. Description of Related Art

Many portable electronic devices such as mobile phones, have housings with an interior compartment for receiving a printed circuit board (PCB) therein. The mobile phones usually include a side key assembly on an outer sidewall of the housing, so that user can operate the mobile phone with just one finger. However, many known side key assemblies have complicated configurations. Additionally, typical side key assembly uses a spring to restore it, however, the spring is subject to fatigue after using it many times.

Therefore, there is a room for improved in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the exemplary housing and method of making the housing. Moreover, in the drawings like reference numerals designate corresponding parts throughout the several views. Wherever possible, the same reference numbers are used throughout the drawings to refer to the same or like elements of an embodiment.

DETAILED DESCRIPTION

Figure 1:
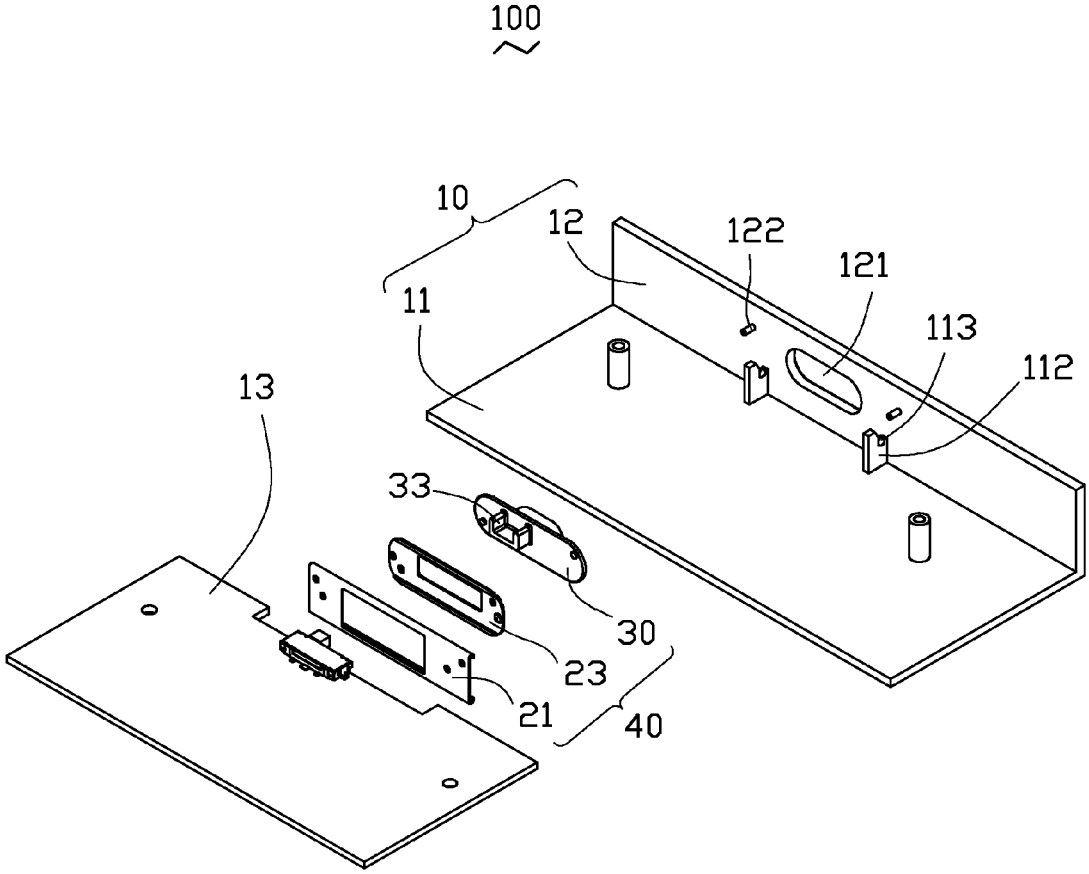
FIG. 1 is an exploded view of an electronic device with a key button mechanism according an exemplary embodiment.
Figure 6:
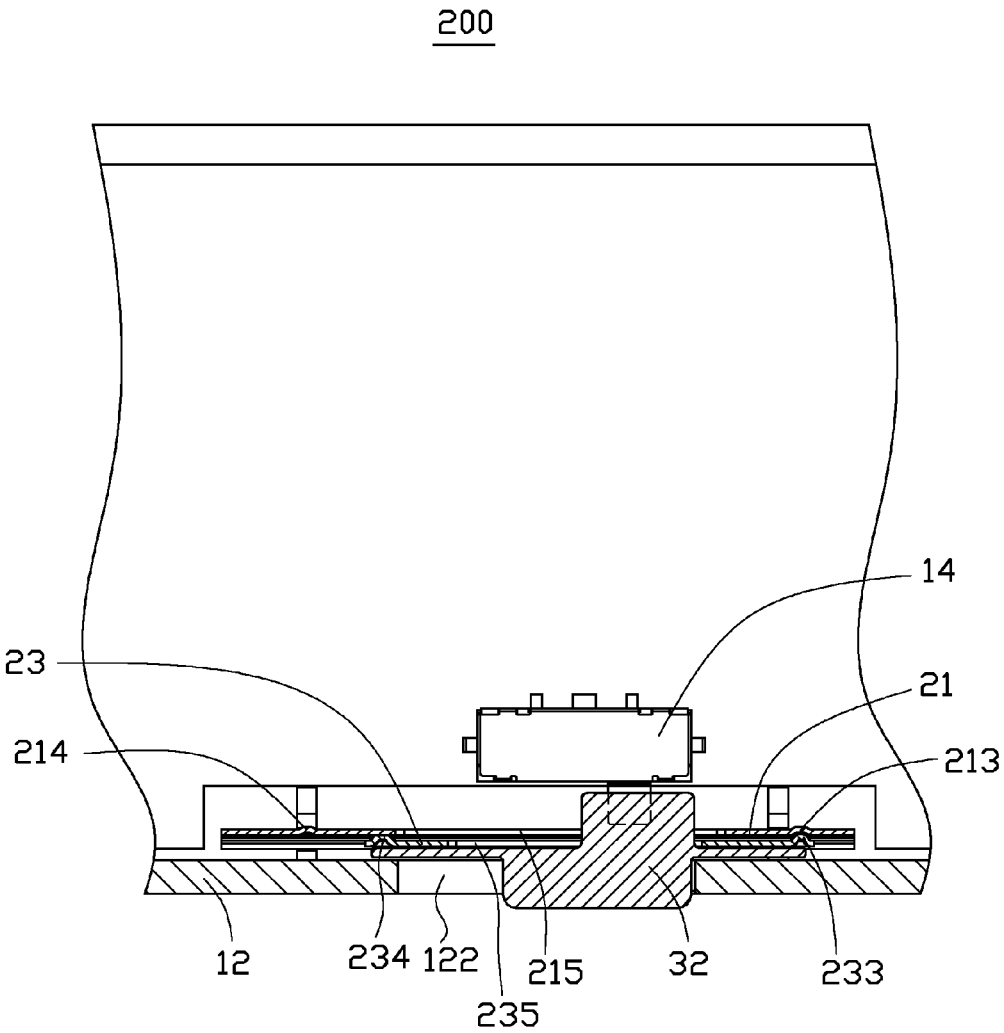
FIG. 6 is a cross sectional view of part of the electronic device of FIG. 5 along a line of VI-VI when the electronic device is in a first configuration.
Figure 7:
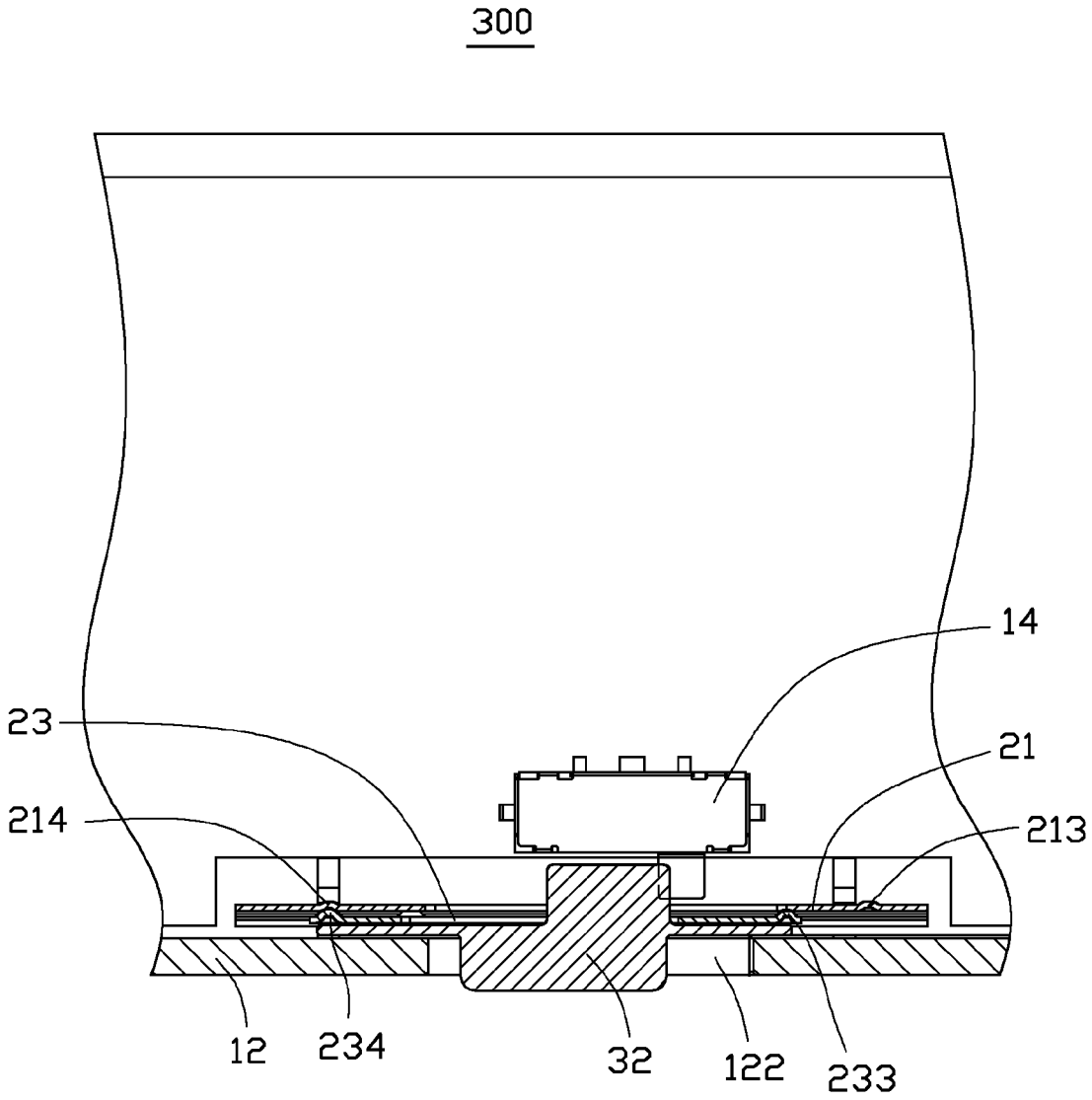
FIG. 7 is similar to the FIG. 6, but showing the electronic device in a second configuration.

An embodiment of an electronic device 100 incorporating a key button mechanism 40 is shown in FIGS. 1, 6 and FIG. 7. FIG. 1 illustrates an exploded view of the electronic device 100. FIG. 6 illustrates a cross section of the key button mechanism 40 in a first (circuit-open) configuration 200. FIG. 7 illustrates a cross section of the key button mechanism 40 in a second configuration (circuit-closed) 300.

Referring to FIG. 1, the exemplary device 100, which may be a mobile phone in this case, includes the key button mechanism 40, a housing 10, and a printed circuit board (PCB) 13.

The housing 10 includes a main body 11 and a sidewall 12, which connects to the main body 11. The housing 10 also includes a passage 121 defined through the side wall 12, two opposite latching members 112 protruding from an inner surface of the side wall 12, and two retaining poles 122 protruding from the inner surface of the side wall 12. Each latching member 112 defines a latching groove 113 configured to retain the key button assembly 40 in the housing 10. The retaining poles 122 are configured to locate and retain the key button assembly 40 on the housing 10.

Referring to FIGS. 2-5, the key button mechanism 40 includes a retaining board 21, and a sliding board 23 slidably mounted to the retaining board 21 by a slide enabling member (not labeled), and a key button 30 fixed (e.g., hot-melted) to the sliding board 23. The retaining board 21 defines two retaining holes 216 corresponding to the retaining poles 122. Each retaining pole 122 is retained in one of the retaining holes 216 and portions of the retaining board 21 are secured in the latching grooves 113 so the retaining board 21 is fixed to the housing 10. The retaining board 21 defines an opening 215. When the retaining board 21 is affixed to the housing 10, the opening 215 is aligned with the passage 121 for the key button 30 to pass through. The sliding board 23 defines a trough 235 aligned with the opening 215 and the passage 121, to allow the key button 30 to pass through the sliding board 23. The key button 30 includes a main body 31, a button 32 protruding from one side of the main body 31 and an actuator 33 protruding from another side of the main body 31.

Figure 3:
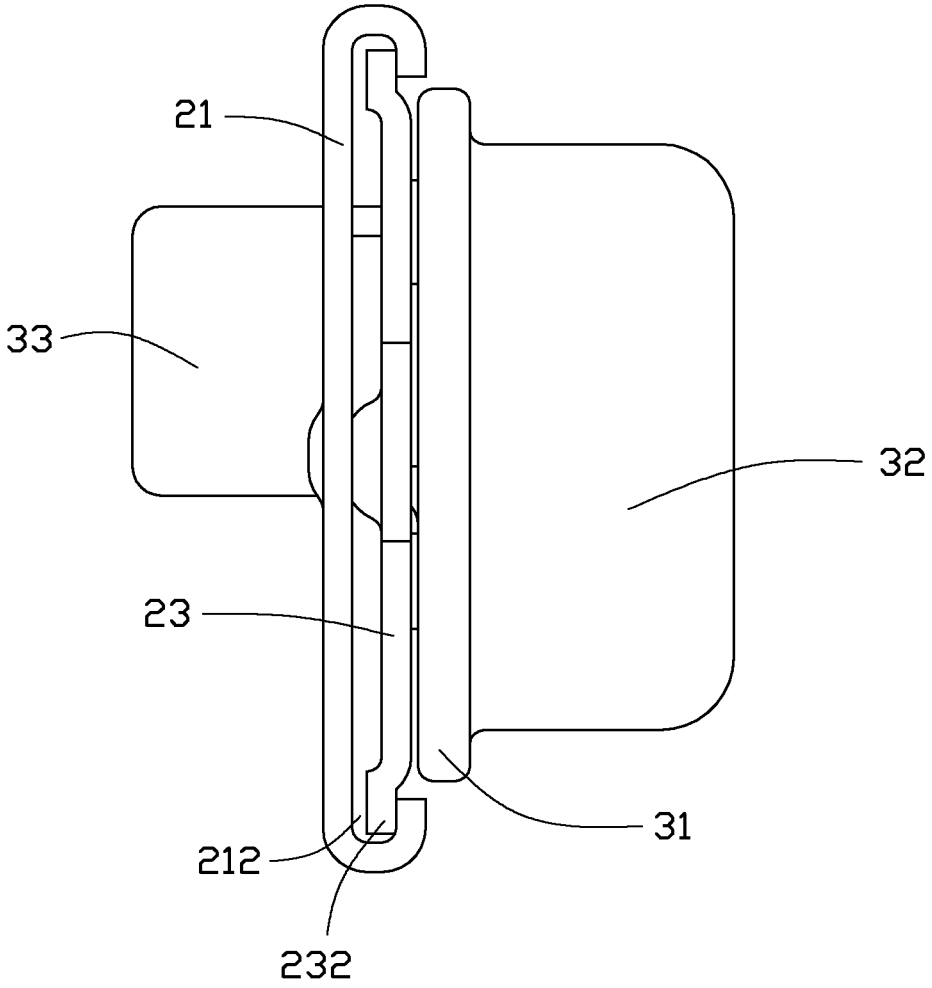
FIG. 3 is a plan view of the assembled key button mechanism of FIG. 2.
Figure 4:
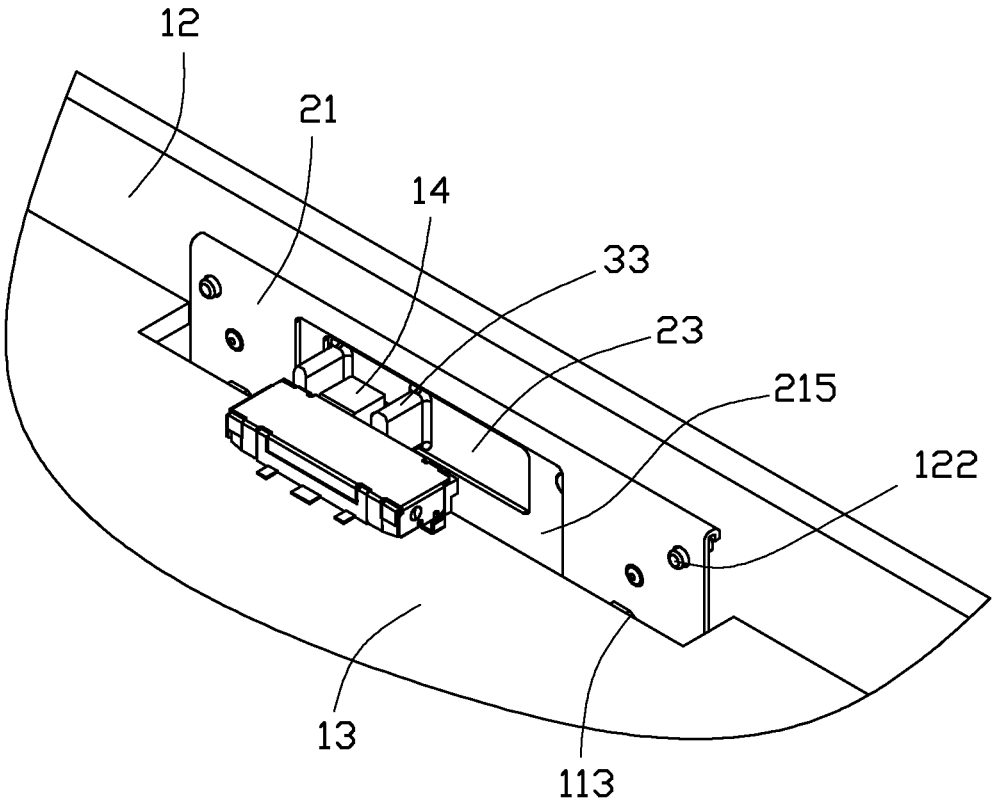
FIG. 4 is a partially enlarged view of the assembled electronic device of FIG. 1.
Figure 5:
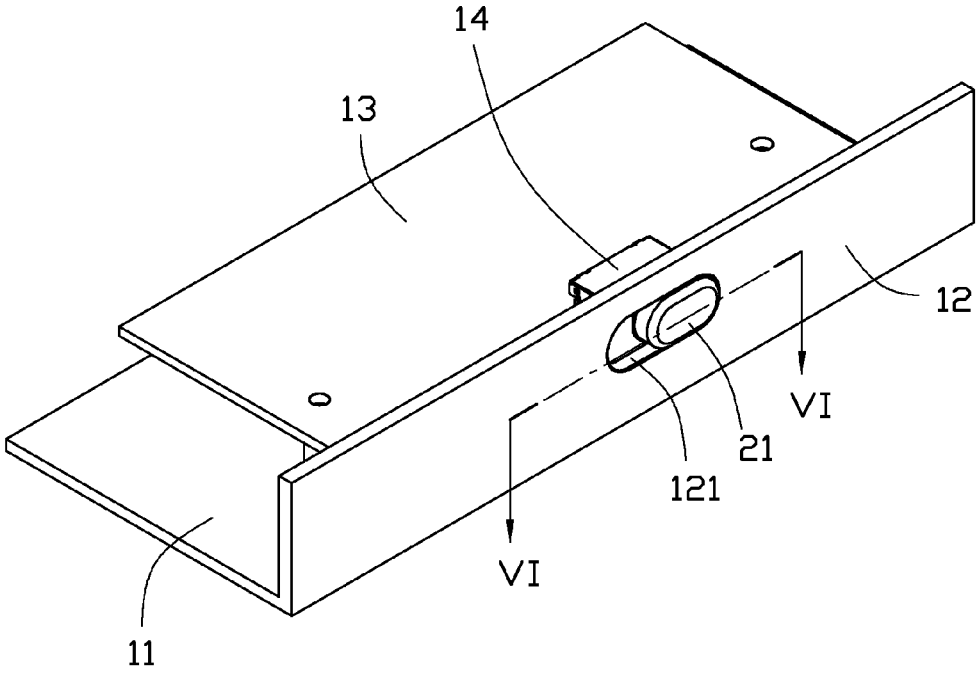
FIG. 5 a view of part of the electronic device of FIG. 1, assembled.

Referring to FIG. 3, the slide enabling member, in this embodiment, includes a pair of rails 232 and a pair of flanges biased inwards from the long edges (tracks 212), which are slidably engaged by the rails 232. The rails 232 are carried on the sliding board 23, that is to say, each rail 232 protrudes from a side of the sliding board 23. The rails 232 in the tracks 212 allow the sliding board 23 to slide between the first configuration 200 and the second configuration 300. The rails 232 may be positioned on either the retaining, hoard 21 or the sliding board 23, and the rail engaging members (e.g. the tracks 212) may be positioned on the element opposite the rails 232.

The PCB 13 has a switch 14 aligned with the passage 121 when the PCB 13 is positioned in the housing 10. A user can apply fingernail pressure to the button 32 in the longitudinal direction of the device 100 to cause the key button 30 and the sliding board 23 to slide from the first configuration 200 to the second configuration 300 with respect to the housing 10, so the switch 14 can be actuated by the actuator 33.

Figure 2:
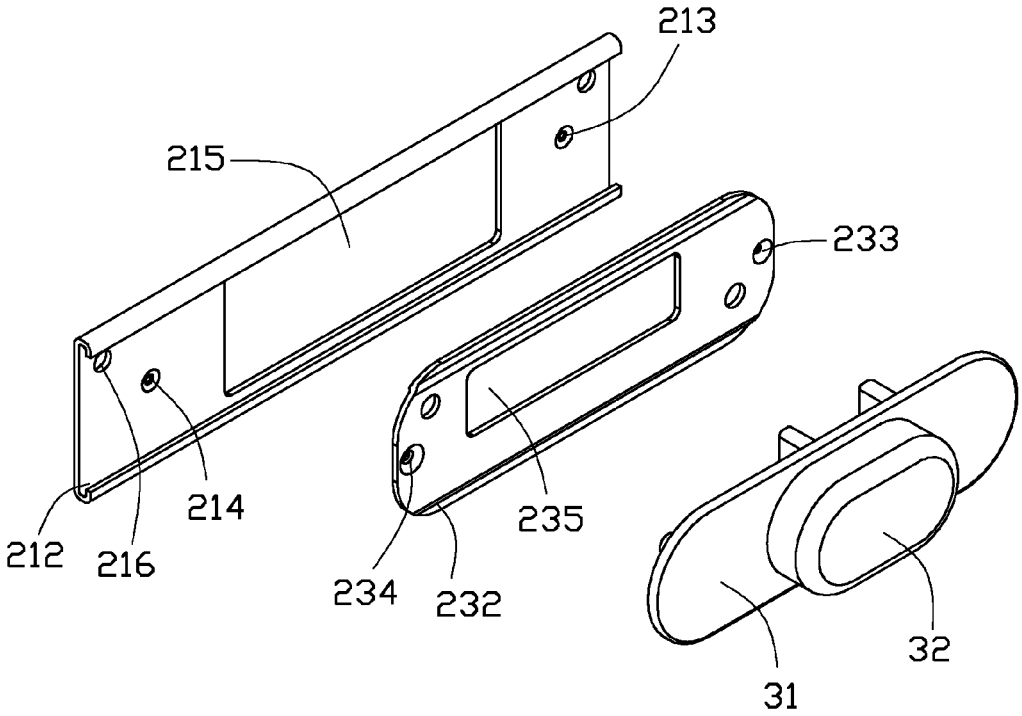
FIG. 2 is an exploded view of the key button mechanism of FIG. 1, but showing the key button mechanism from another aspect.

Referring to FIGS. 2 and 6-7, the key button mechanism 40 further includes a stopping member (not labeled) located between the sliding board 23 and the retaining hoard 21, for holding the sliding board 23 in the first configuration 200 or in the second configuration 300. The stopping member includes a first stopping protrusion 233, a first stopping groove 213 engaging the first stopping protrusion 233, a second stopping protrusion 234 and a second stopping groove 214 engaging the second stopping protrusion 234. The first stopping protrusion 233 is sized and shaped to fit tightly in the first stopping groove 213 when the sliding board 23 is slid to the first configuration 200. The second stopping protrusion 234 is sized and shaped to fit tightly in the second stopping groove 214 when the sliding board 23 is slid to the second configuration 300. In this embodiment, both the first stopping protrusion 233 and the second stopping protrusion 234 protrudes from the sliding board 23, both the first stopping groove 213 and the second stopping groove 214 are defined in the retaining hoard 21. The stopping member or parts of it may be made from resilient materials.

It is to be understood, however, that even though numerous characteristics and advantages of the exemplary disclosure have been set forth in the foregoing description, together with details of the structure and function of the disclosure, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. An electronic device, comprising:

a housing including a main body and a sidewall, two opposite latching members protruding from an inner surface of the sidewall, each latching member defining a latching groove, two retaining poles protruding from the inner surface of the side wall;

a printed circuit board mounted to the housing, the printed circuit board comprising a switch; and a key button mechanism, comprising:

a retaining board defining two retaining holes, portions of the retaining board retained to the latching grooves of the housing and each retaining pole retained in one of the retaining holes;

a sliding board slidably mounted to the retaining board, the sliding board being capable of sliding between a first configuration and a second configuration;

a key button fixed to the sliding board so the key button slides relative to the retaining board with the sliding hoard, the key button comprising an actuator; and a stopping member located between the retaining board and the sliding board, the stopping member holding the sliding board in the first configuration or the second configuration;

wherein when the sliding board slides from the first configuration to the second configuration, the switch is actuated by the actuator.

2. The electronic device as claimed in claim 1, wherein the stopping member comprises a first stopping protrusion, a first stopping groove engaging the first stopping protrusion, a second stopping protrusion and a second stopping groove engaging the second stopping protrusion; the first stopping protrusion is fitted in the first stopping groove to hold the sliding board in the first configuration; the second stopping protrusion is fitted in the second stopping groove to hold the sliding board in the second configuration.

3. The electronic device as claimed in claim 2, wherein both the first stopping protrusion and the second stopping protrusion protrude from the sliding board, both the first stopping groove and the second are defined in the retaining board.

4. The electronic device as claimed in claim 1, further comprising a slide enabling member, the sliding board is slidably mounted to the retaining board by the slide enabling member.

5. The electronic device as claimed in claim 4, wherein the slide enabling member comprises a set of rails and a set of tracks slidably engaging the rails; the sliding board slides along the rails between the first configuration and the second configuration.

6. The electronic device as claimed in claim 5, wherein the rails are carried on the sliding board; the tracks are carried on the retaining board.

7. The electronic device as claimed in claim 1, wherein the sidewall defines a passage, the retaining board defines an opening aligned with the passage for the key button passing through.

8. The electronic device as claimed in claim 7, wherein the sliding board defines a trough aligned with the opening to allow the key button pass through the sliding board.

* * * * *